United States Patent [19]

Davis et al.

[11] 3,986,216

[45] Oct. 19, 1976

[54] TOILET

[75] Inventors: Robert B. Davis, New Britian; John F. Maslow, Broad Brook; Frank J. Bogusz, Farmington, all of Conn.

[73] Assignee: Koehler-Dayton, Inc., New Britian, Conn.

[22] Filed: Nov. 3, 1975

[21] Appl. No.: 628,572

Related U.S. Application Data

[63] Continuation-in-part of Ser. No. 555,504, March 17, 1975, abandoned.

[52] U.S. Cl. ..... 4/10; 4/115; 4/76; 4/77; 4/85; 4/90

[51] Int. Cl.[2] ..... E03D 3/00; E03D 5/01; E03D 5/016

[58] Field of Search ..... 4/28, 18, 27, 26, 20, 4/29, 30, 67 R, 61, 62, 90, 60, 52, 25, 10

[56] References Cited

UNITED STATES PATENTS

| | | | |
|---|---|---|---|
| 2,763,871 | 9/1956 | Rutherford | 4/85 X |
| 2,820,967 | 1/1958 | Dean et al. | 4/85 X |
| 3,520,003 | 7/1970 | Shaw | 4/77 |
| 3,545,011 | 12/1970 | Helke et al. | 4/10 |
| 3,748,681 | 7/1973 | Hiller | 4/115 |
| 3,798,681 | 3/1974 | Johansen | 4/85 |
| 3,883,903 | 5/1975 | Broek et al. | 4/85 |
| 3,905,049 | 9/1975 | Stokes | 4/10 |
| 3,939,501 | 2/1976 | Sargent | 4/78 |

*Primary Examiner*—Henry K. Artis
*Attorney, Agent, or Firm*—Spencer T. Smith

[57] ABSTRACT

A toilet comprising a toilet bowl including a flushing manifold, a first discharge opening, and a second opening proximate the discharge opening, means for selectively closing the first discharge opening so that the discharge of the contents of the toilet bowl through the discharge opening will be prevented, means for delivering a predetermined volume of flushing medium under pressure to the toilet bowl when the dicharge opening is closed, a conduit extending between the second opening and the flushing manifold including a pump, and means for operating the pump for a selected period of time after the predetermined volume of flushing medium has been delivered to the toilet bowl.

14 Claims, 4 Drawing Figures

Fig_3
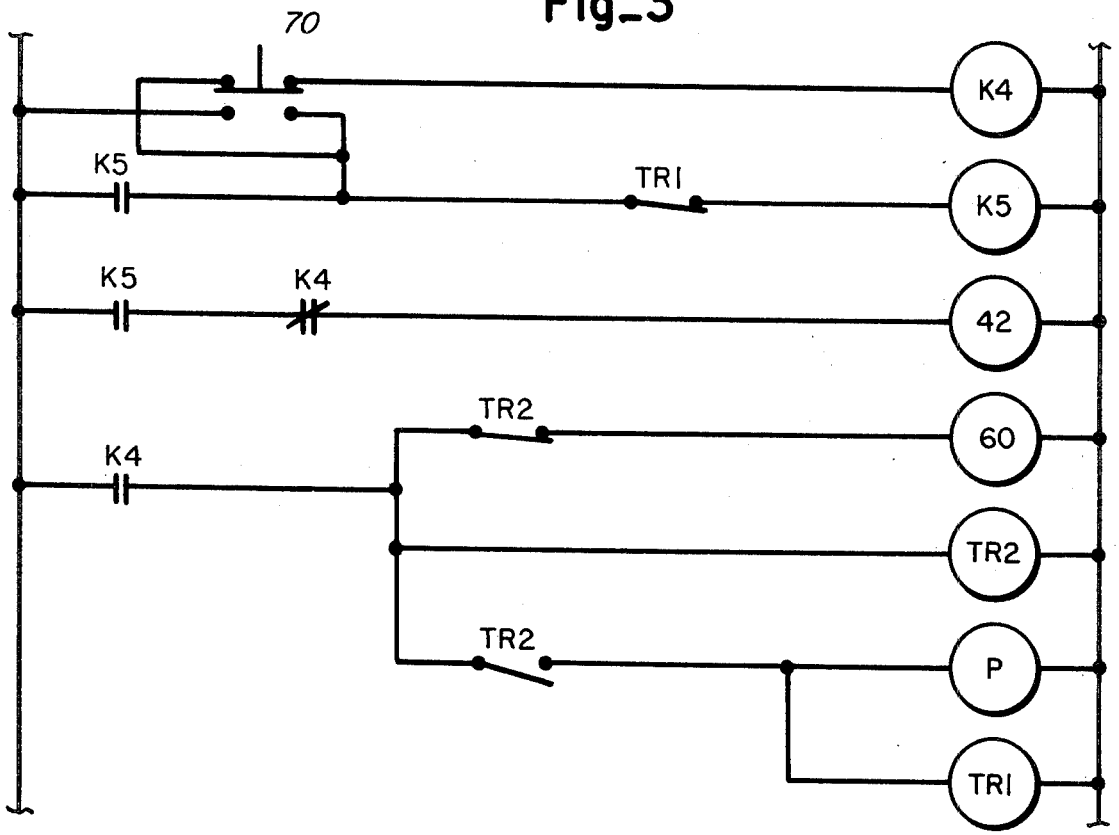
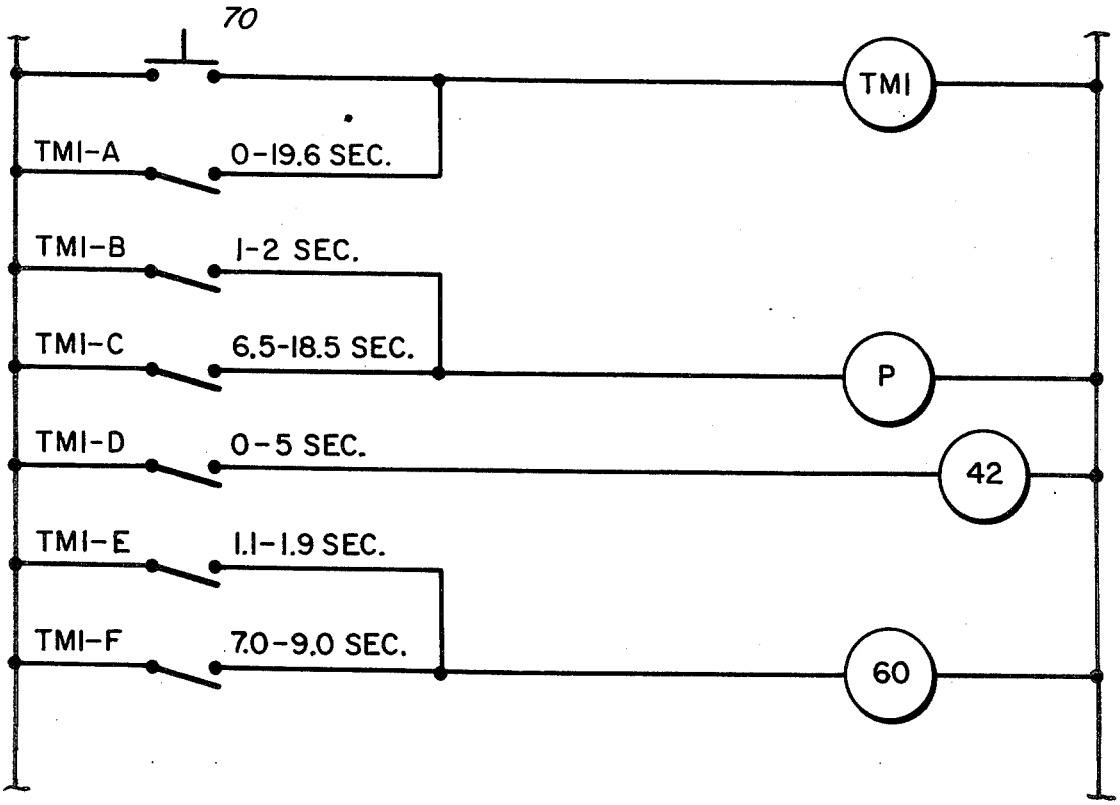
Fig_4

TOILET

This application is a continuation-in-part of copending application Ser. No. 555,504, filed Mar. 17, 1975, now abandoned.

The present invention relates to low volume flush toilets which utilize a liquid such as potable water as the flushing medium. Low volume flush toilets are often utilized in trains and other vehicles which have a very limited capability of supplying liquid flushing medium. Since these toilets are flushed with a very small volume of flushing liquid, the toilet bowl is not cleaned by the flushing medium to the extent which is possible with conventional high volume flush toilets.

It is accordingly, and object of the present invention to provide a toilet, which while using a very small volume of flushing liquiid per use, will be maintained in a very clean condition.

Other objects and advantages of the present invention will become apparent from the following portion of this specification and from the accompanying drawings which illustrate in accordance with the mandate of the patent statutes presently preferred embodiments incorporating the principles of the invention.

Referring to the drawings:

FIG. 3 is an electronic schematic illustrating a first operational cycle for the toilets illustrated in FIGS. 1 and 2, and FIG. 4 is an electronic schematic illustrating a second operational cycle for the toilets illustrated in FIGS. 1 and 2.

Figure 1:
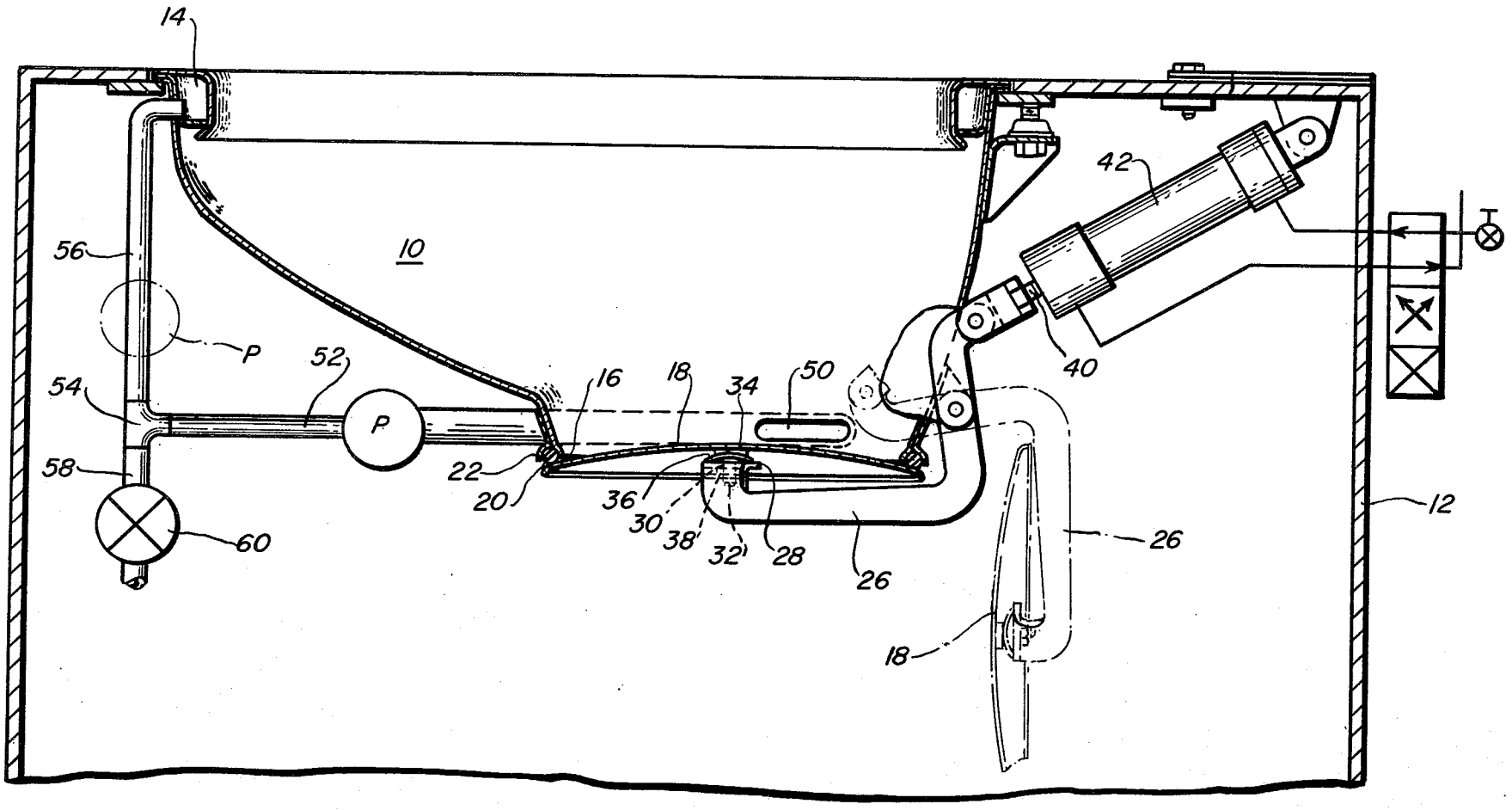
FIG. 1 is a cross-sectional view of a toilet made in accordance with the teachings of the present invention.

The toilet illustrated in FIG. 1 includes a bowl structure 10, which is secured to the top surface of a cabinet 12. The bowl structure includes a flushing manifold 14 which extends about the upper periphery of the bowl structure. The details of the flushing manifold may be as disclosed in U.S. Pat. No. 3,538,518.

The bottom discharge opening 16 of the bowl structure is selectively closed by a closure of valve member 18, which may have a slightly spherical configuration for strength purposes. The closure member is displaceable from a substantially vertical position illustrated in phantom in FIG. 1, whereat the discharge opening is open thereby permitting the bowl contents to drain into the cabinet or into any other suitable structure to a substantially horizontal position, whereat the closure member forcefully engages an O-ring 20, which is maintained within an annular channel 22 established proximate the discharge opening 16, to effectively seal or close the drainage opening.

The movement of the closure member 18 is controlled by a control arm 26 which is pivotally mounted on the bowl structure. One end of the control arm 26 includes a bracket portion 28, which includes an aperture 30 through which a bolt 32 extends. The head 34 of the bolt is welded to the underside of the closure member 18, and a Belleville washer 36 is located intermediate the head 34 and the top surface of the bracket portion 28 to provide a degree of resilience between the closure member 18 and the control arm 26. The compression of the Belleville washer can be controlled as desired by tightening or loosening a nut 38 which is threadedly received by the bolt 32. Once the desired compression has been established, the nut 38 can be welded to the bolt 32.

The other free and of the control arm 26 is pivotally connected to the rod portion 40 of an air biased, normally retracted air cylinder 42. The closure member accordingly will effectively close the drainage opening except when the air cylinder is energized. The rear end of the air cylinder is suitably pivotally mounted on the cabinet.

A second continuously open aperture 50 is defined in the bowl structure 10 proximate the bottom discharge opening 16. A fluid conduit 52, which includes a normally deenergized pump P extends between this aperture 50 and one port of a T-shaped fluid connector 54. The pump may alternately be located in a second fluid conduit 56 which extends between the flushing manifold 14 and a second port of the T-connector. An intake conduit 58 extends between the third port of the T-connector and a selectively energized solenoid valve 60. The normally closed solenoid valve 60 controls the flow of pressurized flushing medium, such as potable water, from a suitable source (not shown). When energized, the solenoid valve permits fluid to flow through the second fluid conduit 56 to the flushing manifold and conjointly through the first fluid conduit 52 into the bowl thereby backwashing the pump and the second aperture 50.

Figure 2:
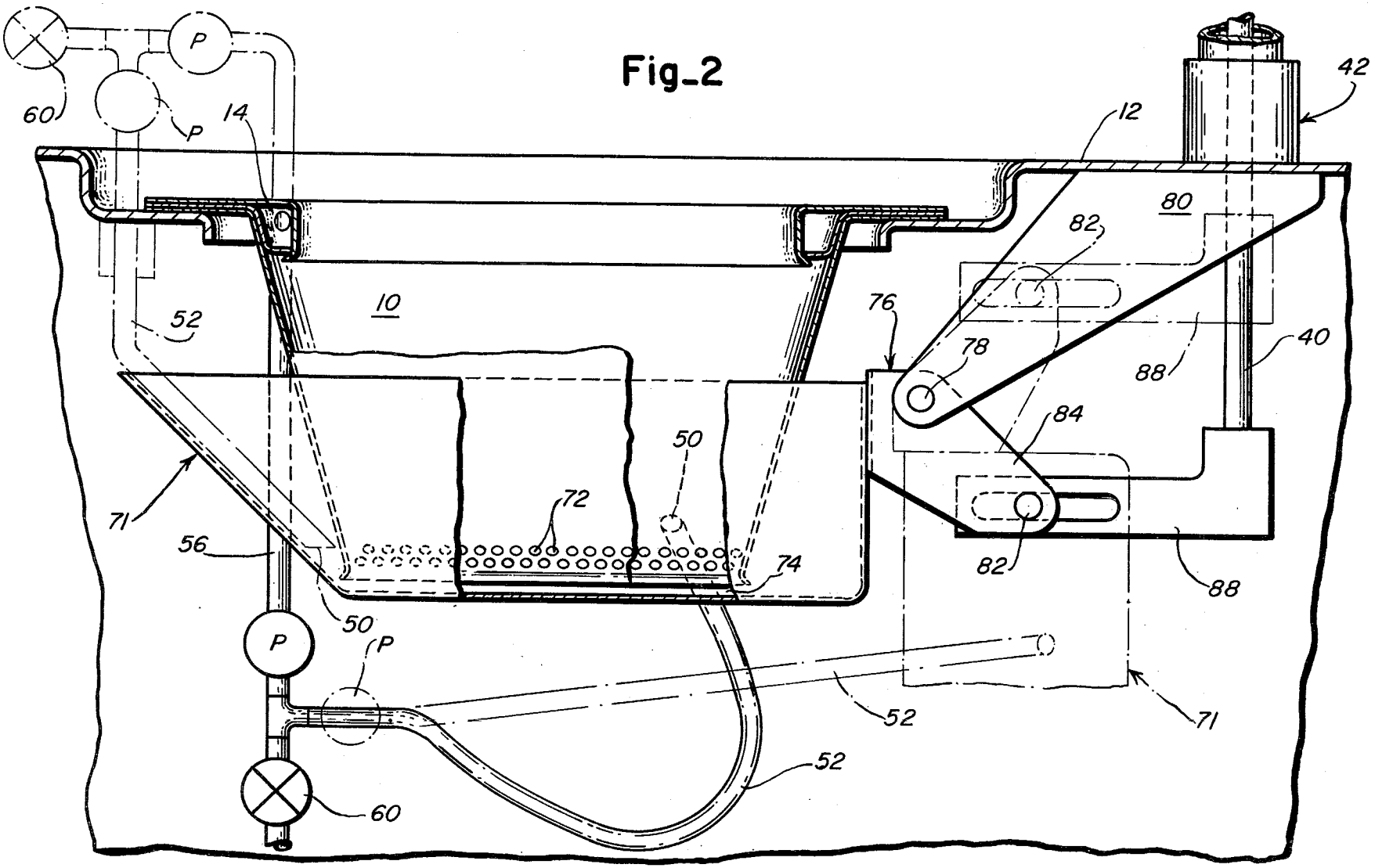
FIG. 2 is a side elevational view partly in section of a toilet having a second preferred embodiment made in accordance with the teachings of the present invention.

In the second preferred embodiment illustrated in FIG. 2, a water seal is provided by displacing a cup-shaped flapper member 71 from a retracted position (illustrated in broken lines) where it assumes a substantially vertical position allowing discharge of the toilet bowl 10 to an advanced position where it assumes a substantially horizontal orientation. The height of the flapper element is selectively chosen to prevent the overflow of a predetermined volume of flushing medium, introduced into the toilet bowl, from the flapper member.

The flapper 71 includes an integral, bifurcated pivot bracket 76 which is pivotally supported by the horizontally disposed support pin 78 of a support bracket 80. A pivot pin 82 horizontally extends between the opposed arms 84 of the pivot bracket and is received within a slot 86 in a shift fork 88 and the shift fork is secured to the rod of vertically oriented air cylinder 42 which is mounted on the top of the cabinet 12.

The second toilet bowl opening may be established in the side wall of the flapper element communicating with the first fluid conduit 52, which would be flexible to permit its extension as illustrated. Alternately, the second toilet bowl opening can be established at the bottom of the second conduit which would be of rigid character extending downwardly betwen the inner surface of the flapper element and the outer surface of the bowl structure. The pump P may either be located within the second conduit 56 so that it can be operated when the solenoid 60 is actuated to effectively step up the pressure of the flushing media or alternately it may be located within the first conduit.

The operation of the toilet in a first sequence can best be understood from a discussion of FIG. 3. When the toilet is to be flushed, flush button or switch 70 is depressed to close a circuit through normally closed contacts of a first timer TR1 to generate a logic signal K5. The generation of the logic signal K5 closes a second circuit which energizes the air cylinder 42. The closure member is accordingly displaced to its vertical position allowing the bowl structure to completely drain.

When the flush switch 70 is released, a circuit is closed to generate a second logic signal K4. The air cylinder 42 is according deenergized and the closure member is displaced to the horizontal position to effectively seal the discharge opening 6. Conjointly with the deenergization of the air cylinder 42, the normally closed solenoid valve 60 and a second timer TR2 are energized. Pressurized priming liquid will accordingly conjointly flow to the flushing manifold 14 and through the first fluid conduit 52 into the bowl structure for a period of time set by the second timer TR2. When the second timer TR2 times out, the normally closed contacts of the timer open and the solenoid is deenergized. A predetermined volume of flushing medium will accordingly be introduced into and contained by the toilet bowl structure.

When the second timer times out, the pump P will be operated for a period of time set by the now energized first timer TR1. The pump accordingly recirculates the contained flushing medium under pressure to the flushing manifold. The period of the first timer TR1 is chosen to assure that the pump will repetitively recirculate the contained flushing medium for a period of time sufficient to thoroughly cleans the toilet bowl.

An alternate sequence is illustrated in FIG. 4. This alternate sequence is controlled by a rotatable switching member TM1 (a motor driven timer) including a plurality of camming elements for selectively closing each of the individual control circuits (TM1-A, etc.). When the flush button 70 is depressed this switching member commences to rotate. The air cylinder is immediately actuated to retract the flapper 71 to permit complete drainage of the toilet bowl. With the flapper retracted, the solenoid valve 60 is operated after 1.1 seconds until 1.9 seconds of the cycle, to permit a small volume of flushing liquid (one pint, for example) to be washed down the toilet bowl to wash paper or the like from the toilet bowl. The pressure of this flushing medium is stepped up by the operation of the pump from one second to two seconds of the cycle. The toilet bowl will drain for 3.1 seconds after this washing takes place whereupon the flapper will be advanced. At 6.5 seconds of the cycle, the recirculating pump will be energized for a period of twelve seconds and one-half second after pump energization for the second time, the solenoid valve 60 will again be energized for a period of two seconds. A selected volume (two pints) of flushing media will accordingly be introduced into the toilet bowl and will be continuously recirculated for approximately eleven and one-half seconds whereupon the recirculating pump P will be deenergized. The toilet is then ready for use.

To assure that a free flow of flushing medium will be pumped to the flushing manifold, apertures 72 are provided in the lowermost annular portion of the toilet bowl and a slight clearance 74 is established between the bottom of the flapper at the advanced position and the bottom of the toilet bowl.

What is claimed is:

1. A toilet comprising
a toilet bowl including
an inlet opening,
a discharge opening, and
a third opening proximate said discharge opening, means for selectively closing said discharge opening so that discharge of the contents of said toilet bowl through said discharge opening will be prevented,
means for delivering a predetermined volume of flushing medium, free from human waste, to said inlet opening to be contained within said toilet bowl, when said discharge opening is closed,
conduit means extending between said third opening and said inlet opening.
said conduit means including pump means, and
means for operating said pump means for a selected period of time for repetitively redelivering said predetermined volume of flushing medium contained by said toilet bowl to said inlet opening.

2. A toilet according to claim 1, wherein said delivering means includes said conduit means.

3. A toilet according to claim 1, wherein said closing means comprises
a closure member
a pivotally mounted control arm fixedly secured to said closure member, and
a hydraulic cylinder operatively associated with said control arm for selectively displacing said closure member from a first position whereat said discharge opening is open to a second position whereat said discharge opening is closed.

4. A toilet according to claim 3, wherein said closure member forcefully engages said toilet bowl when said closure member is displaced to said second position.

5. A toilet according to claim 1, further comprising means for delivering a predetermined volume of flushing liquid to said toilet bowl when said discharge opening is open.

6. A toilet comprising
a toilet bowl including
a bowl structure having an inlet opening and a discharge opening,
means for preventing the drainage of said bowl structure through said drainage opening including
a member selectively displaceable intermediate retracted and advanced positions, and
means for displacing said member from said retracted position to said advanced position, and
means for permitting the drainage of said bowl structure including means for moving said member from said advanced position to said retracted position,
means for delivering a predetermined volume of flushing medium free from human waste to said inlet opening to be contained within said toilet bowl,
means for withdrawing flushing medium contained by said toilet bowl and directing the withdrawn flushing medium to said inlet opening, and
means for preparing said toilet bowl for use including
means for actuating said moving means whereby said bowl structure will drain,
means for actuating said displacing means after said bowl structure has drained,
means for activating said delivering means after said member has been displaced to said advanced position, and
means for operating said withdrawing and directing means for a predetermined interval of time to repetitively redeliver said predetermined volume of flushing liquid to said inlet opening.

7. A toilet according to claim 6, wherein said bowl structure includes a third opening and said withdrawing and directing means comprises conduit means including pump means extending between said inlet opening and said third opening.

8. A toilet according to claim 6, wherein said preparing means further comprises means for supplying a predetermined volume of flushing liquid to said inlet opening after said moving means has been activated and prior to the actuation of said displacing means.

9. A toilet according to claim 6, wherein said selectively displaceable member comprises a cup-shaped flapper.

10. A toilet according to claim 9, wherein the bottom of said flapper member is spaced from the bottom of said structure bowl when said flapper member is displaced to said advanced position.

11. A toilet according to claim 10, wherein a plurality of apertures are defined in the lowermost annular portion of said structure bowl.

12. A toilet according to claim 6 wherein said cup-shaped flapper member includes a third opening and said withdrawing and directing means conduit means including pumping means extending between said inlet opening and said third opening.

13. A toilet according to claim 6, wherein said selectively displaceable member forcefully engages said bowl structure closing said drainage opening at said advanced position.

14. A toilet according to claim 9, wherein said withdrawing means comprises a conduit having a free end selectively located intermediate said cup-shaped flapper and said bowl structure.

* * * * *